US011147380B2

(12) United States Patent
Suprun et al.

(10) Patent No.: US 11,147,380 B2
(45) Date of Patent: Oct. 19, 2021

(54) ADJUSTABLE STOOL

(71) Applicants: Yoav Suprun, Miami, FL (US); Tanya L. Daniels, Des Moines, IA (US)

(72) Inventors: Yoav Suprun, Miami, FL (US); Tanya L. Daniels, Des Moines, IA (US)

( * ) Notice: Subject to any disclaimer, the term of this patent is extended or adjusted under 35 U.S.C. 154(b) by 0 days.

(21) Appl. No.: 16/853,004

(22) Filed: Apr. 20, 2020

(65) Prior Publication Data

US 2020/0345145 A1 Nov. 5, 2020

Related U.S. Application Data

(60) Provisional application No. 62/841,559, filed on May 1, 2019.

(51) Int. Cl.

| | |
|---|---|
| ***A47C 7/14*** | (2006.01) |
| ***A47C 7/40*** | (2006.01) |
| ***A47C 4/46*** | (2006.01) |
| ***A47C 4/50*** | (2006.01) |
| ***A47C 7/50*** | (2006.01) |
| ***A47C 9/00*** | (2006.01) |
| ***A47C 7/46*** | (2006.01) |

(52) U.S. Cl.

CPC ..... *A47C 7/144* (2018.08); *A47C 7/402* (2013.01); *A47C 7/46* (2013.01); *A47C 7/462* (2013.01); *A47C 7/506* (2013.01); *A47C 7/5062* (2018.08); *A47C 7/5064* (2018.08); *A47C 9/007* (2013.01)

(58) Field of Classification Search

CPC ..... A47C 7/402; A47C 7/46; A47C 7/462; A47C 7/506; A47C 7/5062; A47C 9/02; A47C 9/007; A47C 9/08; A47C 9/025; A61G 5/1067

USPC ..... 297/284.4, 284.7, 353, 383, 423.19, 297/423.38, 423.25, 426.38

See application file for complete search history.

(56) References Cited

U.S. PATENT DOCUMENTS 280,907 A * 7/1883 Burlingame ..... A47C 7/5064 297/423.38
341,748 A * 5/1886 Haynes ..... A47C 7/40 297/383
417,681 A * 12/1889 Parmelee ..... A47C 1/035 297/70
573,133 A * 12/1896 Browne ..... A47C 3/28 297/338

(Continued)

FOREIGN PATENT DOCUMENTS

AT 200100903 A * 2/2003 ..... A47C 9/08
CN 208582021 U * 3/2019

(Continued)

OTHER PUBLICATIONS 3 page PDF of machine translation of CN-20852021-U. (Year: 2019).*

(Continued)

*Primary Examiner* — Robert Canfield
(74) *Attorney, Agent, or Firm* — Zarley Law Firm, P.L.C.

(57) ABSTRACT

An adjustable stool having a support connected to a base at one end and seat at the opposite end. A foot rest is adjustably connected to the support. Adjustably connected to the seat is a back support. A lumbar support is adjustably connected to the back support. The back support has a horizontal portion and a vertical portion.

18 Claims, 4 Drawing Sheets

(56) References Cited

U.S. PATENT DOCUMENTS 590,268 A * 9/1897 Lee ..... A61G 5/12 297/423.23
611,327 A * 9/1898 Kelly ..... A47C 7/506 297/423.37
1,401,834 A * 12/1921 Tretter ..... A47D 1/004 297/383
1,606,840 A * 11/1926 Koenigkramer ..... A47C 3/28 108/146
1,723,363 A * 8/1929 McArdle ..... A47C 7/004 297/423.38
1,964,216 A * 6/1934 Sargent ..... A47C 7/506 297/423.38
2,054,557 A * 9/1936 Cramer ..... A47C 7/402 297/358
2,364,261 A * 12/1944 Wood ..... A47C 3/18 297/298
2,542,480 A * 2/1951 Cramer ..... A47C 3/24 248/408
2,692,012 A * 10/1954 Cramer ..... A47C 7/443 297/298
3,278,229 A * 10/1966 Bates ..... A47C 3/18 297/344.18
3,376,068 A * 4/1968 Walkinshaw ..... A47C 7/5062 297/423.38
3,458,234 A * 7/1969 Bates ..... A47C 7/004 297/423.38
3,642,320 A * 2/1972 Ward ..... A47C 3/18 297/344.18
3,820,844 A * 6/1974 Fortnam ..... A47C 7/52 297/423.37
3,854,772 A * 12/1974 Abrahamson ..... A47C 7/402 297/353
3,952,987 A * 4/1976 Bevington ..... A47C 3/34 248/408
4,012,158 A * 3/1977 Harper ..... A47C 7/402 403/107
4,102,549 A * 7/1978 Morrison ..... A47C 1/023 297/353
4,148,524 A * 4/1979 Guyton ..... A47C 7/506 248/188.5
4,238,097 A * 12/1980 Clausen ..... A47B 19/06 248/188.7
4,348,051 A * 9/1982 Boucher ..... A47C 7/004 297/423.38
4,623,195 A * 11/1986 Avella ..... A47C 7/004 248/230.2
4,767,160 A * 8/1988 Mengshoel ..... A47C 7/52 297/423.12
4,790,600 A * 12/1988 Behringer ..... A47C 1/022 297/296
5,152,581 A * 10/1992 Norsworthy ..... A47C 9/08 297/423.28
5,575,534 A * 11/1996 Yu ..... A47C 9/005 297/452.21
5,660,442 A * 8/1997 Tornero ..... A47C 1/0307 297/411.36
5,769,497 A * 6/1998 Tsai ..... A47C 1/03 297/411.36
5,782,532 A * 7/1998 Opsvik ..... A47C 3/20 297/338
5,988,754 A * 11/1999 Lamart ..... A47C 7/506 297/423.38
6,036,268 A * 3/2000 Larson ..... A47C 7/506 297/423.26
6,062,647 A * 5/2000 Mei ..... A47C 1/0305 297/411.36
6,149,239 A * 11/2000 Markussen ..... A47C 7/52 248/123.11
6,296,313 B1 * 10/2001 Wu ..... A47C 1/0305 297/411.35
6,648,417 B1 * 11/2003 Gilbert ..... A47C 7/506 297/423.19
6,695,407 B1 * 2/2004 Lin ..... A47C 1/02 297/423.38
8,104,838 B2 * 1/2012 Tsai ..... A47C 1/0307 297/411.37
8,177,297 B2 * 5/2012 Powell ..... A47D 1/004 297/148
9,144,315 B1 * 9/2015 Cheng ..... A47C 7/506
2003/0151291 A1 * 8/2003 Lin ..... A47C 7/5064 297/423.38
2007/0290541 A1 * 12/2007 Tsai ..... A47C 7/52 297/423.1
2015/0238014 A1 * 8/2015 Kessler ..... A47C 7/5066 297/423.1

FOREIGN PATENT DOCUMENTS

DE 2727408 A1 * 1/1979 ..... A47C 7/5066
DE 2837558 A1 * 3/1980 ..... A47C 7/5066
DE 102004050859 A1 * 4/2006 ..... A47C 9/02
FR 2406435 A1 * 5/1979 ..... A61G 15/00
SU 578950 A * 11/1977 ..... A47C 1/034
WO WO-2012165463 A1 * 12/2012 ..... A47C 7/506

OTHER PUBLICATIONS 5 page PDF machine translation DE 2837558 A1. (Year: 1980).*
3 page PDF of machine translation of SU 578950-A. (Year: 1977).*

* cited by examiner

ADJUSTABLE STOOL

CROSS REFERENCE TO RELATED APPLICATION

This application claims the benefit of the priority of U.S. Provisional Application No. 62/841,559 filed on May 1, 2019, the contents of these applications are hereby incorporated by reference in their entirety.

BACKGROUND OF THE INVENTION

The present invention is directed to an adjustable stool and more particularly an adjustable stool having a lumbar support.

Stools are well-known in the art for use at bars and the like. Most stools have fixed dimensions based upon the average height of individuals. While useful, conventional stools can be uncomfortable for individuals who are short or tall. Further, most stools provide little if any lumbar support and for those that do, the support is not properly positioned. Therefore, a need exists in the art for a device that addresses these deficiencies.

An objective of the present invention is to provide a stool that is adjustable for both tall and short people.

Another objective of the present invention is to provide a stool having an adjustable lumbar support.

These and other objectives will be apparent to those having ordinary skill in the art based on the following written description, drawings and claims.

SUMMARY OF THE INVENTION

An adjustable stool having a base with a support that extends vertically from the base. A foot rest is adjustably connected to the support. Attached to an end of the support opposite the base is a seat.

Adjustably attached to the seat is a back support that is adjustable in a horizontal direction in relation to the seat. A lumbar support is adjustably connected to the back support and is adjustable in a vertical direction in relation to the seat.

DETAILED DESCRIPTION OF THE PREFERRED EMBODIMENTS

Figure 1:
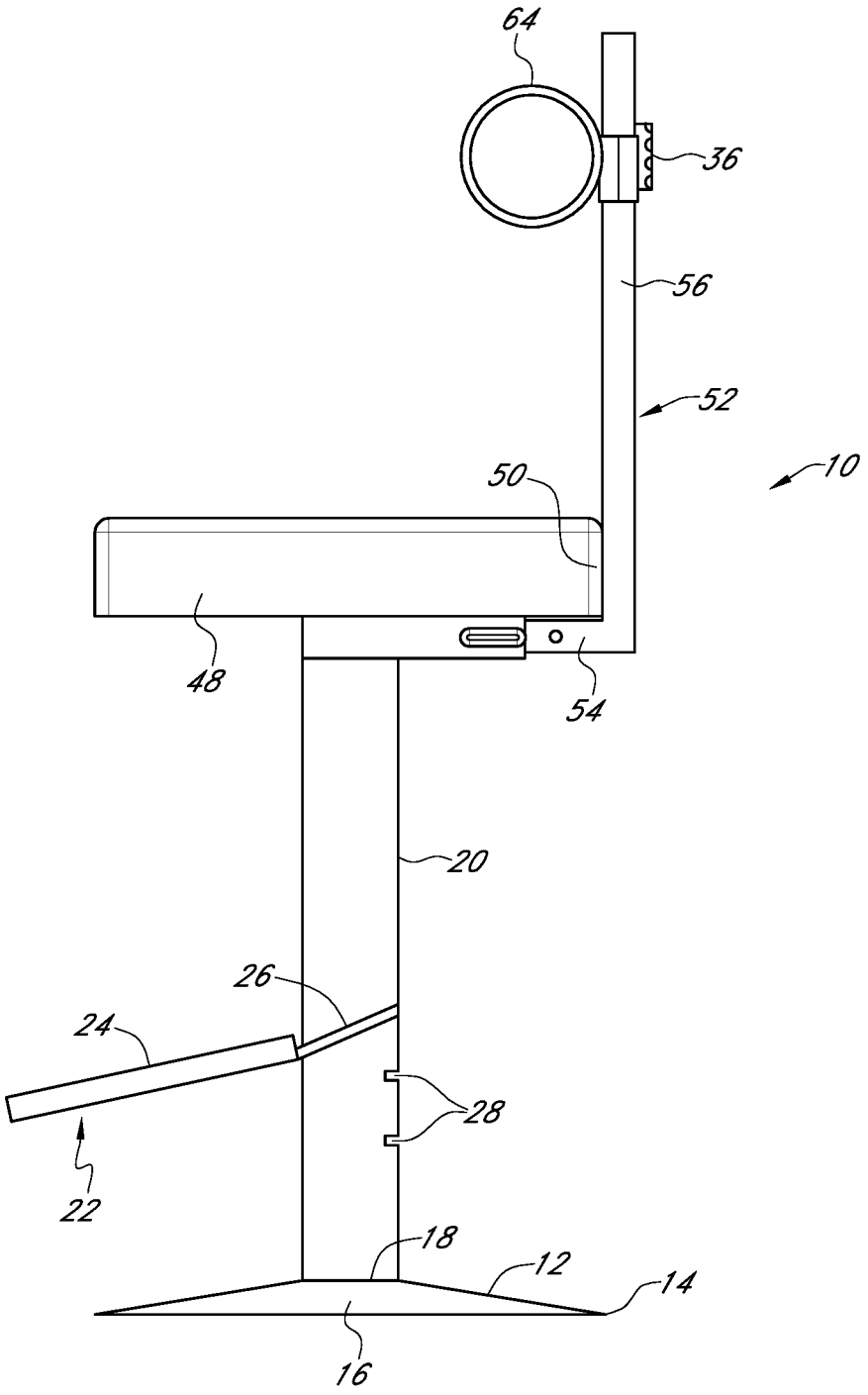
FIG. 1 is a side view of an adjustable stool.
Figure 2:
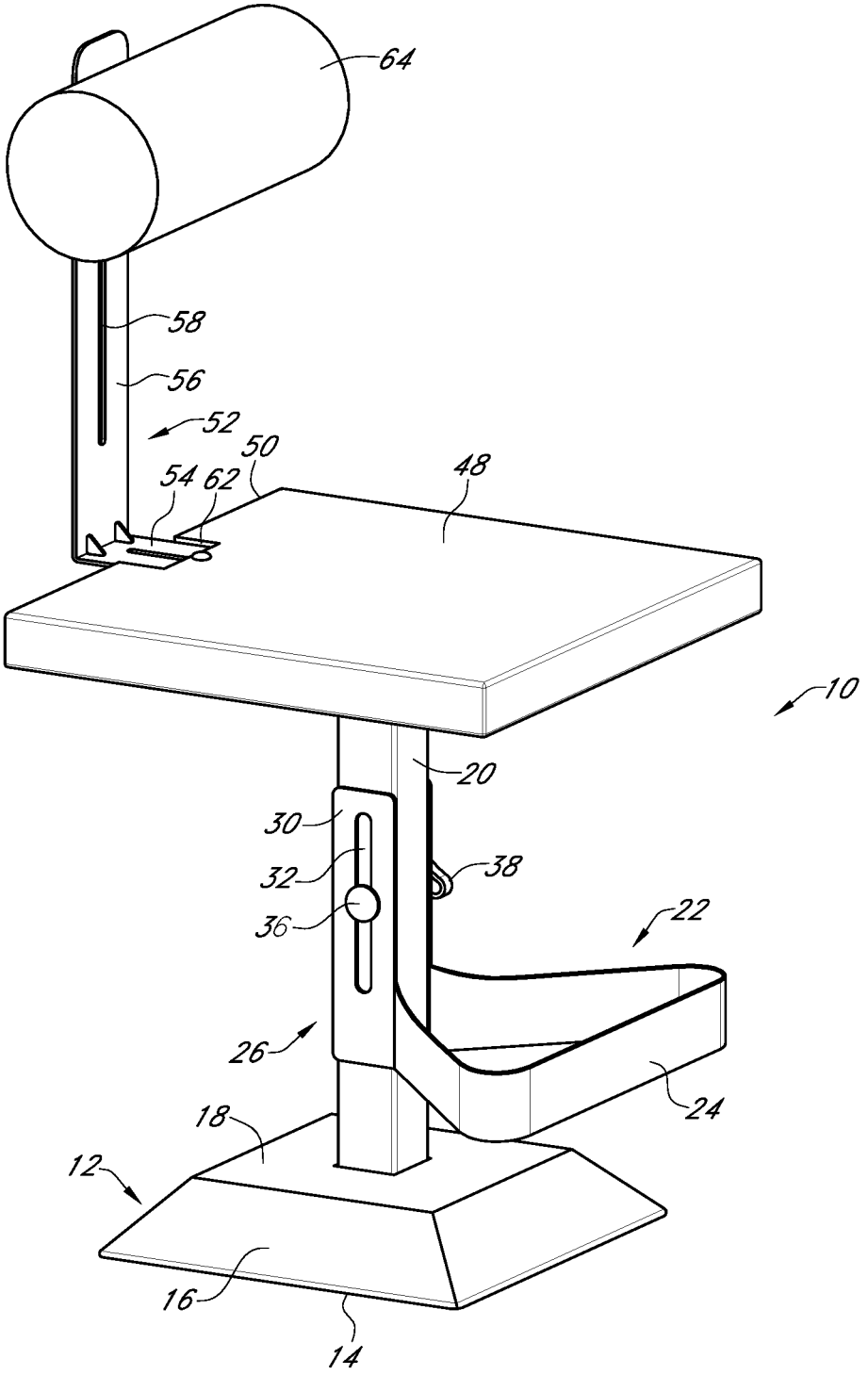
FIG. 2 is a perspective view of an adjustable stool.
Figure 3:
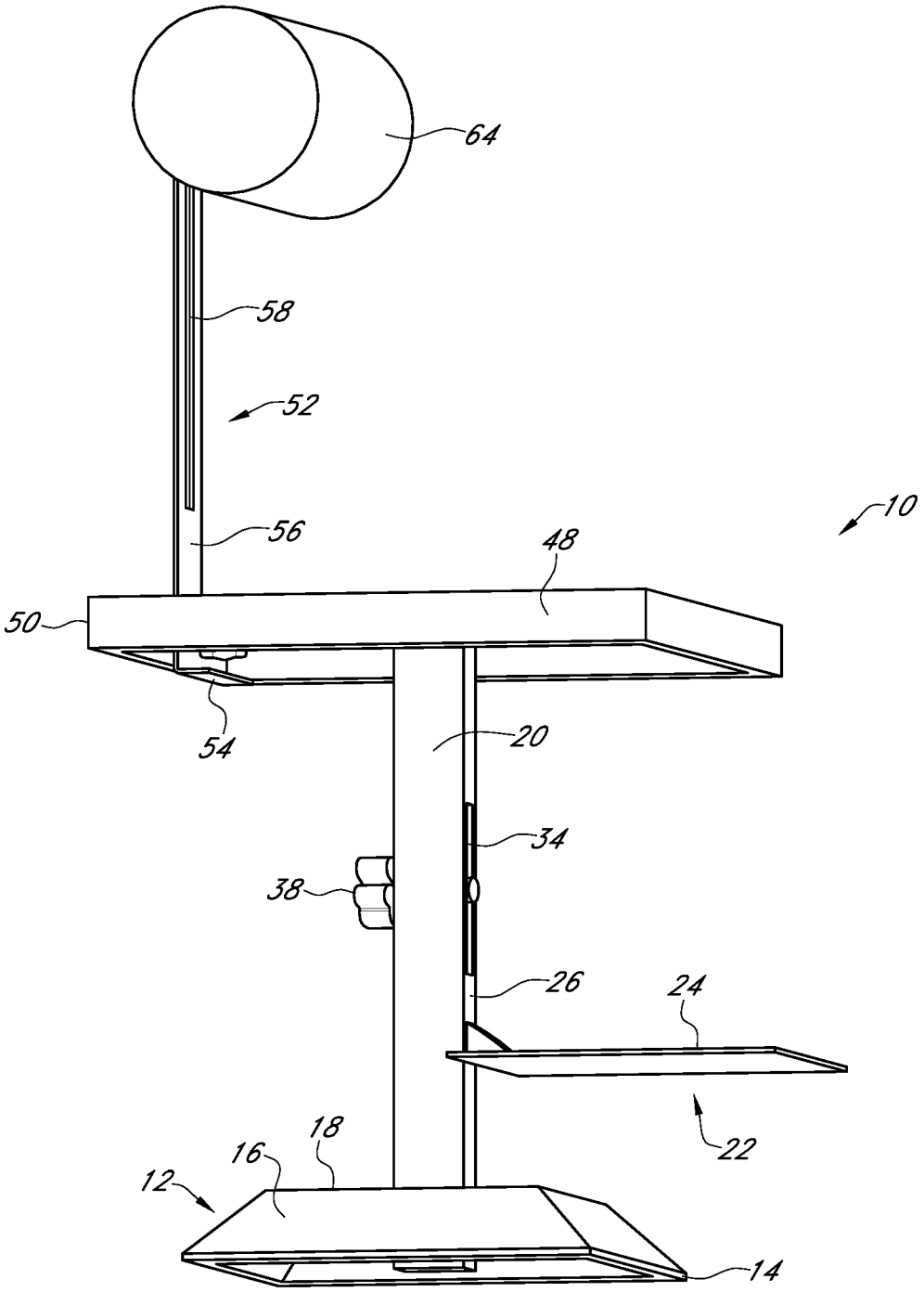
FIG. 3 is a perspective view of an adjustable stool.
Figure 4:
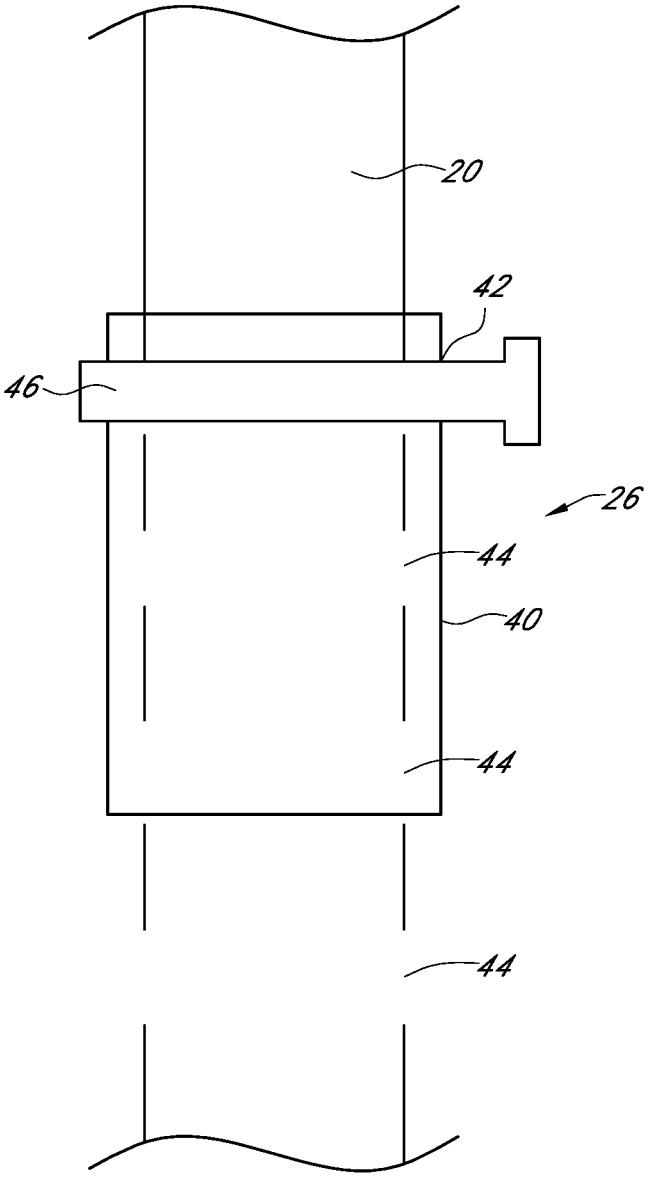
FIG. 4 is a side sectional view of an adjustable stool.

Referring to the Figures, an adjustable stool 10 includes a base 12. The base 12 is of any size, shape, and structure. In one example shown, the base 12 has an outer edge 14 and side walls 16 that angle inwardly to a top wall 18. Extending vertically through the top wall 18 of the base 12 is at least one vertical support 20. The vertical support 20 is of any size, shape, and structure and in one example, as shown, is a rectangular tube.

Adjustably connected to the vertical support 20 is a foot rest 22. The foot rest 22 is of any size, shape, and structure. Generally, the foot rest 22 has a foot engaging portion 24 connected to an adjustable portion 26. The adjustable portion 26 is of any form. In one example, the adjustable portion 26 is a horizontal bar adapted to be selectively received within horizontal notches or grooves 28 that are vertically spaced on a back side of the vertical support 20.

In another example, the adjustable portion 26 includes a pair of vertical plates 30 having a centralized vertical slot 32. The vertical slot 32 aligns with a vertical slot 34 in the vertical support 20. A bolt 36 extends through slots 32 and 34 and is received within a tightening nut 38. The tightening nut 38 is rotated on the bolt 36 to engage a plate 30 and hold the foot rest 22 in a selected position.

In yet another embodiment, the adjustable portion 26 has a bracket 40 that fits about the vertical support 20. The bracket 40 has a hole 42. The hole 42 is positioned to selectively align with holes 44 in the vertical support 20 that are vertically spaced. The holes 42 and 44 are adapted to receive a locking pin 46.

Connected to a top end of the vertical support 20 is a seat 48. Adjacent the back 50 of the seat 48 is a back support 52. The back support member 52 has a horizontal portion 54 and a vertical portion 56 that form an L-shape. Both the horizontal 54 and vertical 56 portions have elongated slots 58. The horizontal portion 54 is connected to a bottom 60 of the seat 48 and is aligned with a cut-out section 62 on the back 50 of the seat 48. Bolts 36 are slidably received within slots 58 of the horizontal 54 and vertical 56 portions and are connected to a tightening nut 38.

One of the bolts 36 is connected to a lumbar support 64. The lumbar support 64 is of any size, shape, and structure. In the example shown, the lumbar support 64 is cylindrical.

In operation the stool 10 is adjustable in three ways to accommodate the differing heights of an individual, as well as provide proper support for an individual's lumbar. First, the foot rest 22 is adjusted to provide a comfortable distance between the seat 48 and the foot rest 22 similar to the distance between an individual's knee and foot.

Second, the back support member 52 is adjusted horizontally toward and away from the seat 48. In one example, the tightening nut 38 is loosened and the back support member 52 is moved toward or away from the seat to a distance similar to the distance between an individual's knee and spine. Once positioned, the tightening nut 38 is tightened to lock the back support 52 in the selected position.

Finally, the lumbar support 64 is adjusted vertically up or down along the vertical portion 56 of the back support 52. In one example, the tightening nut 38 is loosened and the lumbar support 64 moved to a position that aligns with an individual's lumbar. Once positioned, the tightening nut 38 is then tightened to lock the lumbar support 64 in the selected position.

Accordingly, an adjustable stool 10 has been disclosed that is adjustable to accommodate individuals of different height that also supports an individual's lumbar.

From the above discussion and accompanying figures and claims it will be appreciated that the stool 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. An adjustable stool, comprising:
a base;
a support extending vertically from the base;
a foot rest adjustably attached to the support;
a seat attached to an end of the support opposite the base;
a back support adjustably connected to the seat;
the back support having a horizontal portion and a vertical portion, wherein the horizontal portion has a first elongated slot and the vertical portion has a second elongated slot; and
a lumbar support adjustably connected to the back support;
wherein a horizontal portion of the back support aligns with a cut-out section on a back of the seat.

2. The stool of claim 1 wherein the back support is adjustable in a horizontal direction in relation to the seat.

3. The stool of claim 1 wherein the lumbar support is adjustable in a vertical direction in relation to the seat.

4. The stool of claim 1 wherein the foot rest is adjustable in a vertical direction in relation to the base.

5. The stool of claim 1 wherein the foot rest has a foot engaging portion and an adjustable portion.

6. The stool of claim 1 wherein the foot rest has an adjustable portion that is a horizontal bar that is selectively received in one of a plurality of notches vertically spaced on a back side of the support.

7. The stool of claim 1 wherein the foot rest has an adjustable portion, wherein the adjustable portion comprises a pair of vertical plates each having a centralize vertical slot that receives a bolt.

8. The stool of claim 1 wherein the foot rest has an adjustable portion, wherein the adjustable portion comprises a bracket that fits about the vertical support, and the bracket having a hole that selectively aligns with one of a plurality of holes vertically spaced on the support and the hole receives a locking pin.

9. The stool of claim 1 further comprising a first bolt slidably received within the first slot of the horizontal portion and connected to the seat such that the distance between the vertical portion and the seat is adjustable.

10. The stool of claim 1 further comprising a second bolt slidably received within the second slot of the vertical portion and connected to the lumbar support such that the distance between the horizontal portion and the lumbar support is adjustable.

11. An adjustable stool, comprising:
a base;
a support extending vertically from the base;
a foot rest adjustably attached to the support;
a seat attached to an end of the support opposite the base;
a back support adjustably connected to the seat;
the back support having a horizontal portion and a vertical portion, wherein the horizontal portion has a first elongated slot and the vertical portion has a second elongated slot; and
a lumbar support adjustably connected to the back support;
wherein the foot rest has an adjustable portion that is a horizontal bar that is selectively received in one of a plurality of notches vertically spaced on a back side of the support.

12. The stool of claim 11 wherein the back support is adjustable in a horizontal direction in relation to the seat.

13. The stool of claim 11 wherein the lumbar support is adjustable in a vertical direction in relation to the seat.

14. The stool of claim 11 wherein the foot rest is adjustable in a vertical direction in relation to the base.

15. An adjustable stool, comprising:
a base;
a support extending vertically from the base;
a foot rest adjustably attached to the support;
a seat attached to an end of the support opposite the base;
a back support adjustably connected to the seat;
the back support having a horizontal portion and a vertical portion, wherein the horizontal portion has a first elongated slot and the vertical portion has a second elongated slot; and
a lumbar support adjustably connected to the back support;
wherein the foot rest has an adjustable portion, wherein the adjustable portion comprises a pair of vertical plates each having a centralize vertical slot that receives a bolt.

16. The stool of claim 15 wherein the back support is adjustable in a horizontal direction in relation to the seat.

17. The stool of claim 15 wherein the lumbar support is adjustable in a vertical direction in relation to the seat.

18. The stool of claim 15 wherein the foot rest is adjustable in a vertical direction in relation to the base.

* * * * *